United States Patent [19]

Kodama

[11] 4,247,932

[45] Jan. 27, 1981

[54] ELECTRONIC TIMEPIECE

[75] Inventor: Yukuo Kodama, Tokyo, Japan

[73] Assignee: Nippon Electric Co., Ltd., Tokyo, Japan

[21] Appl. No.: 70,416

[22] Filed: Aug. 27, 1979

Related U.S. Application Data

[63] Continuation-in-part of Ser. No. 603,710, Aug. 11, 1975.

[51] Int. Cl.[3] ..... G04C 9/00; G04B 17/12

[52] U.S. Cl. ..... 368/187; 368/201

[58] Field of Search ..... 58/23 R, 23 A, 23 AC, 58/50 R, 50 A, 85.5; 235/92 TF, 92 F, 92 S, 92 PE; 368/185–189, 200–202

[56] References Cited

U.S. PATENT DOCUMENTS

| | | | |
|---|---|---|---|
| 3,871,168 | 3/1975 | Maire | 58/85.5 |
| 4,022,017 | 5/1977 | Aoki et al. | 58/23 R |

*Primary Examiner*—Vit W. Miska

[57] ABSTRACT

An electronic timepiece includes frequency-dividing circuit means for generating a first signal of at least 1 Hz from a signal of a predetermined frequency. This first signal is counted by a time counter. The frequency-dividing circuit and the time counter are reset in response to the closing of a first input switch. Circuitry is provided for releasing the frequency-dividing circuit from its reset condition to generate a second signal of at least 1 Hz as a quick advance signal for time setting in response to the closing of a second input switch.

16 Claims, 6 Drawing Figures

ELECTRONIC TIMEPIECE

BACKGROUND OF THE INVENTION

This invention relates to an electronic timepiece, and more particularly to an improved counter circuit which generates a quick advance signal required for time-setting in an electronic timepiece.

In a known type of electronic timepiece, the output of a quartz oscillator, having a predetermined frequency of 128 Hz, is introduced to a first frequency—dividing circuit to obtain a signal of 1 Hz thereby providing a "second" signal. Then the "second" signal thus obtained is counted by a "second" counter, i.e. a sexagesimal counter to obtain a "minute" signal, which in turn is fed to a liquid crystal or LED (light-emitting diode) display element through a decoder to indicate a time value, while the display element is driven according to a signal of a frequency of 32 Hz which has been obtained by dividing the frequency of 128 Hz, thereby effecting the digital time display.

For the time-setting of an electronic timepiece, two switch elements and a second frequency-dividing circuit are conventionally used therein. The first frequency-dividing circuit and the "second" counter are held inactive by closing one of the switch elements, while an output signal of the second frequency-dividing circuit, such as 1 Hz, is sent to the display element as a quick advance signal for setting the time by closing the other switch element. Therefore, the display element is driven by the quick advance signal of 1 Hz during the closed state of the second switch. Accordingly, the displayed minute or hour value advances at a 1 Hz rate from the initially indicated time value during the close-state of the second switch. When the display element indicates the time value at which the timepiece is to be set which passes in little real time, the second switch is turned off to prevent the generation of the quick advance signal. Then, the displayed time maintains the time value at the moment when the second switch is turned off. Thereafter, when the displayed time value is coincident with the real time, the first frequency-dividing circuit and the "second" counter are released from their reset condition by closing the first switch to thereby allow the counter to carry out normal time counting. The time-setting is completed in this manner.

However, in such a method for setting the time, the second frequency-dividing circuit adapted to generate the quick advance signal is necessary, so that an increase in the number of components of the circuit results. With the recent rapid development of integrated circuit technology, a reduction in the number of circuit components is desired by integrated circuit users.

It is accordingly a principal object of the present invention to provide an electronic timepiece which permits accurate time-setting, without providing an additional frequency-dividing circuit for use in generating a quick advance signal.

SUMMARY OF THE INVENTION

An electronic timepiece according to the present invention comprises: a frequency-dividing circuit which feeds an output of at least a 1 Hz signal and, if required, a 2 Hz signal; a time counter which counts the 1 Hz output signals thus obtained; first and second input switches; means for resetting the frequency-dividing circuit and the time counter in response to the closing of said first switch; and means for feeding the 1 or 2 Hz signal as a quick advance signal from the frequency-dividing circuit by releasing the reset condition of the frequency-dividing circuit in response to the closing of the second input switch during the resetting condition of the frequency-dividing circuit and the time counter.

According to the present invention, the specific frequency-dividing circuit required for generating a quick advance signal is eliminated and a single signal frequency-dividing circuit is used commonly for the dual purposes of counting time and generating a quick advance signal, so that the number of circuit components can be reduced. Therefore, the electronic timepiece according to the present invention is suited for the fabrication of an integrated circuit device. Moreover, any error resulting after the time-setting remains the same as that incurred in the prior art electronic timepieces. Accordingly, the electronic timepiece according to the present invention may retain the advantageous characteristics of the prior art electronic timepiece, while reducing the number of circuit components to a great extent.

BRIEF DESCRIPTION OF THE DRAWINGS

The other objects, features and advantages of the present invention will be apparent from the following description when read in conjunction with the accompanying drawings, in which.

DESCRIPTION OF THE PREFERRED EMBODIMENT

Figure 1:
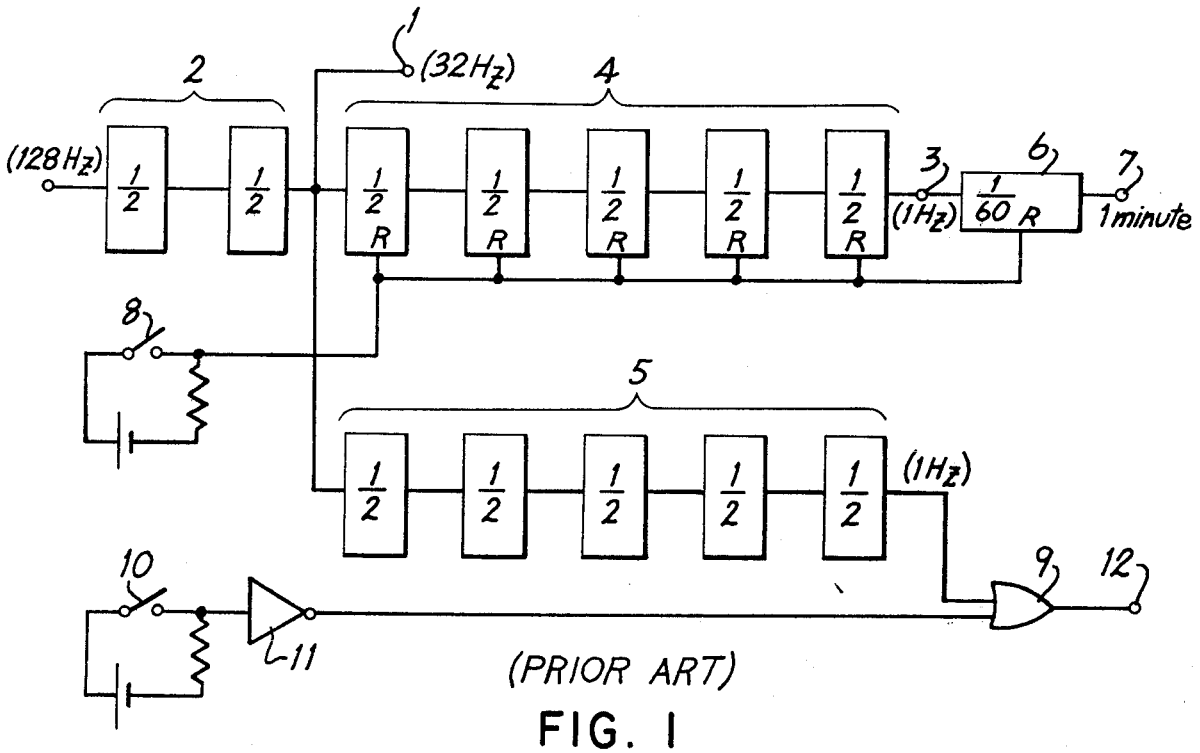
(PRIOR ART) FIG. 1
FIG. 1 is a block diagram of a prior art circuit adapted to generate a quick advance signal.

FIG. 1 shows a circuit adapted to generate a quick advance signal as used in a prior art electronic timepiece. A signal of a frequency of 128 Hz, from a quartz oscillator is fed into a ¼-frequency dividing circuit 2 to obtain a signal of 32 Hz which is used for A.C. driving of a liquid crystal display element at all times. The output of the ¼-frequency-dividing circuit 2 is fed to a first frequency dividing circuit 4 to obtain a "second" signal 3 and into a second frequency-dividing circuit 5 to obtain a signal of 1 Hz. The "second" signal from the first frequency-dividing circuit 4 is fed into the "second" counter 6 to obtain a "minute" signal 7 to operate a liquid crystal. Five ½-frequency dividing circuits constituting the first frequency dividing circuit 4 and the "second" counter 6 are so designed as to be reset according to a signal from a first switch 8. One of the input terminals of a two-input OR gate circuit 9 is adapted to receive a 1 Hz output signal of the second frequency dividing circuit 5, while the other input terminal thereof is adapted to receive a signal from the second switch 10 through an inverter 11. A quick advance signal of 1 Hz is fed as an output from an output terminal 12 of the two-input gate circuit 9.

In the aforesaid circuit arrangement, time setting is performed by utilizing the first and second switches, as has been described. In this case, the maximum counting error experienced is found to be 31.25 mS (1/32 Hz) which is well suited for practical use.

However, the aforesaid prior art circuit arrangement requires, two sets of frequency dividing circuits 4 and 5, increasing the number of components of the circuit considerably. Thus, the circuit arrangement as shown in FIG. 1 is not suited for integrating the circuit, from the viewpoint of the need to decrease the number of circuit components.

Figure 2:
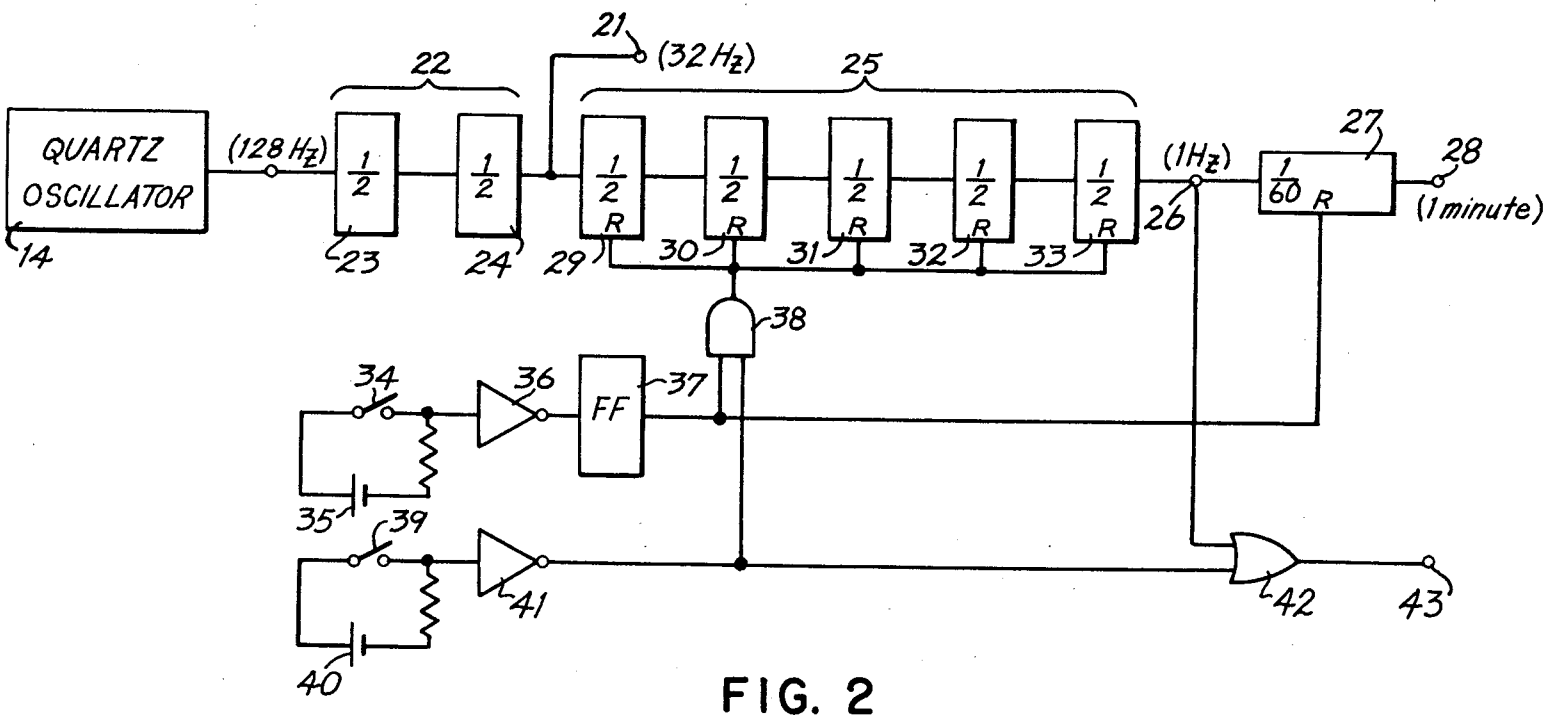
FIG. 2 is a circuit block diagram representing an embodiment of the present invention.

FIG. 2 is a circuit block diagram showing an embodiment of the present invention. As shown, a signal of 128 Hz from a quartz oscillator 14 is fed into a ¼-frequency-dividing circuit 22 to obtain a 32 Hz signal at a terminal 21 which is used for A.C. driving of a liquid crystal display element at all times. The ¼-frequency-dividing circuit 22 is composed of ½-frequency-dividing circuits 23 and 24. The 32 Hz signal 21 is fed into a frequency-dividing circuit 25 to obtain a 1 Hz signal serving as a "second" signal 26 at a junction, and then the aforesaid "second" signal 26 is counted by a "second" counter 27, i.e. a sexagesimal counter, for use in counting "second" signals to obtain a "minute" signal 28 which drives a "minute" sexagesimal counter in the subsequent stage and an "hour" duodecimal counter (not shown), while the "second" signal, "minute" signal and "hour" signal are fed into the liquid crystal display element through decoders, together with the liquid crystal drive signal 21, for the digital display of time. A frequency dividing circuit 25 consists of five ½-frequency dividers 29 to 33, which divide an input signal of 32 Hz to obtain a signal of 1 Hz.

A first input switch 34 for setting the time is ordinarily open to supply the negative potential of an electric power source 35, while this negative potential (hereinafter referred to as low level signal) is reversed by means of an inverter 36 to obtain a clock input of a delayed type flip-flop (D-FF) 37. An output of D-FF37 is one input of a two-input AND gate circuit 38. An output of the AND gate circuit 38 is used as a reset input for ½-frequency dividers 29 to 33 which constitute the frequency-dividing circuit 25. On the other hand, an output of D-FF37 is directly fed as an reset input into a "second" counter 27.

A second switch 39 for setting the time is ordinarily open to supply the negative potential of an electric power source 40, therefore the low level signal is fed, as another input, into the AND gate circuit 38 by way of an inverter 41, while the low level signal is also fed as an input into a two input OR gate circuit 42. On the other hand, the signal 26 of 1 Hz is fed as another input into the OR gate circuit 42, while an output terminal of the gate circuit 42 is connected to a quick advance signal output terminal 43.

In general, a single pole switch, particularly a single-pole single-throw switch is used as each of the time setting switches 34 and 39. Those switches maintain an "on" state, during the time in which the switches are being pushed, thus generating high level signals of power sources 35 and 40. However, in the normal condition, those switches generate low level signals in the open state.

On the other hand, the ½-frequency dividers 29 to 33 and the "second" counter 27 are reset by a reset pulse at a high level.

Figure 3:
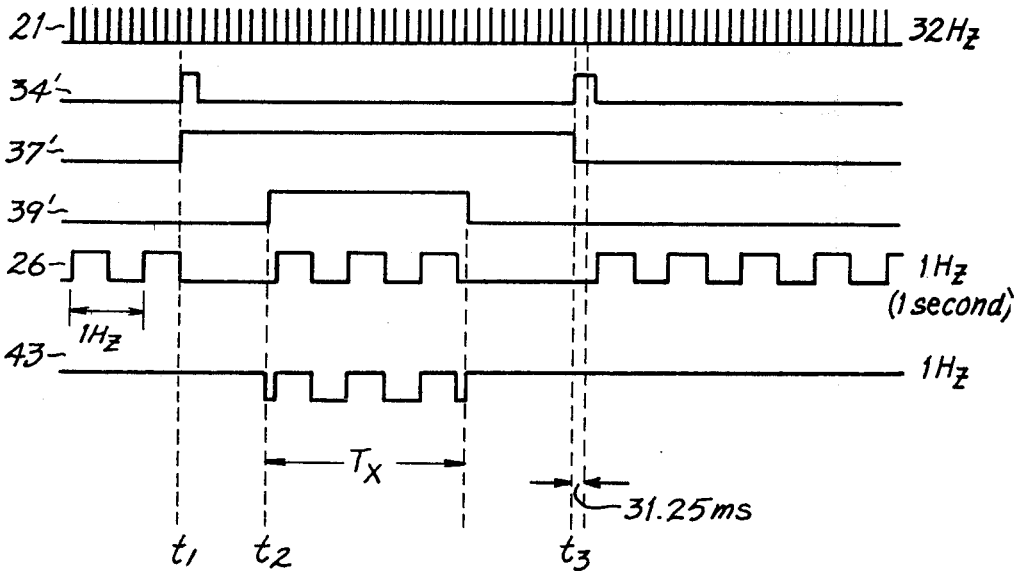
FIG. 3 shows respective timing wave forms in the circuit block diagram of FIG. 2.

The circuit operations are described by referring to FIG. 3.

In the steady condition, the signal of 128 Hz from the quartz oscillator is divided into the signal 21 of 32 Hz by means of the ¼-frequency-dividing circuit 22, while the signal 21 is used as the AC drive signal for the liquid crystal display element. At this time, an output 34' of the switch 34 remains at a low level, so that an output of the inverter 36 maintains a high level. On the other hand, since an output 39' of the switch 39 also remains at a low level, an output of an inverter 41 maintains a high level. However, assuming that an output of D-FF37 remains at a low level, an output of the AND gate circuit 38 remains at a low level, so that the frequency dividing circuit 25 and the "second" counter 27 are maintained in operable condition. As a result, a "second" signal and a "minute" signal are obtained at the terminals 26,28, respectively, and then the signals thus obtained actuate the liquid crystal, together with the aid of the liquid crystal drive signal 21, for indicating the normal time value.

In the case of time-setting, if the switch 34 is instantaneously thrown at the time t1, then a pulse 34' is obtained for an output thereof. The output 37' of D-FF37 changes to a high level from a low level. As a result, the "second" counter 27 may be reset. At this time, another input of the AND gate circuit 38 i.e. an output 41' of the inverter 41 remains at a high level, so that the gate circuit 38 is opened and an output thereof is maintained at a high level, resetting the frequency-dividing circuit 25, as well. In this condition, the "second" and "minute" signals are not fed out for driving the liquid crystal, so that the liquid crystal display element holds the time value indicated at the time t1 when the switch 34 is thrown, intact. Next, the switch 39 is thrown for a desired period Tx from the time t2. As a result, the output 39' of the switch 39, i.e. an input of the inverter 41, becomes a high level and the output 41' of the inverter 41 becomes a low level. Accordingly, during the period Tx, the AND gate circuit 38 is closed and an output thereof remains at a low level, and hence the frequency-dividing circuit 25 is released from its reset condition and a "second" signal 26 is fed into the input terminal of the OR gate circuit 42. Until the time t2 the OR gate 42 is masked by a high level of the output 41' of the inverter 41 so that the level of the output 43 of the OR gate 42 is forcibly made high irrespective of the input signal from the terminal 26. From the time t2 to tx, i.e. for the period Tx, the output 41' of the inverter 41 becomes a low level as mentioned above and as a result, the input signal from the terminal 26 to the OR gate 42 is enabled to appear at the output 43 of the OR gate 42, feeds out a "second" signal at its output terminal 43 as a quick advance signal for use in setting the time. Since the "second" counter 27 remains in a reset condition during the period Tx, a "minute" signal is not fed out from its terminal 28. Therefore, displayed minute or hour value advances at a 1 Hz rate from the indicated time value during the period Tx. When the liquid crystal display element indicates the time value at which the timepiece is to be set and which is slightly beyond the real time, the switch 39 is turned off, and hence the output 41' of the inverter 41 is in a high level. As the result, the output of the AND gate circuit 38 is in a high level and hence the frequency-dividing circuit 25 is reset. Moreover, the output of the OR gate circuit 42 is forcibly made a high level irrespective of the 1 Hz signal at the terminal 26 due to a high level of the output 41′ so that the quick advancing signal is not generated at the terminal 43. Then, the time displayed by the liquid crystal maintains the time value at the moment when the switch 39 is turned off. Therefore, at the time t3 when the displayed time value is coincided with the real time, the switch 34 is closed again instantaneously. Then a pulse 34′ is fed out from the switch 34, and hence the output of D-FF37 is at a low level. Accordingly, the output of the gate circuit 38 is in a low level. As a result, both the frequency-dividing circuit 25 and the "second" counter 27 are released from their reset condition, thus effecting the normal time-counting for the digital display of the real time.

As is apparent from FIG. 3, an error in the timepiece after the time has been set, according to the present invention, is in a range of no more than 31.25 mS (1/32 Hz), so that the accuracy of the same degree as that obtained by the prior art timepiece may be achieved. For a better understanding, of the invention, one example of a display and second, minute, and hour counting portion of an electronic timepiece to be coupled with the advancing signal generator of FIG. 2 will be described with reference to FIG. 4. The output of the seconds counter 27 is applied to a minute counter via an AND gate 50. The other input to the AND gate 50 receives the output of OR gate 42. In normal operation, terminal 43 is at a "high" level irrespective of the signal at the terminal 26 since the output 41′ of inverter 41 is at a "high" level. Therefore, the counting output $\overline{Q}$ of second counter 27 is directly transferred to the input of the minute counter through the AND gate 50. While in a time-setting operation, the output $\overline{Q}$ of second counter 27 is at a "high" level, as the counter is being reset, and the signal at terminal 26, which is transferred to terminal 43 in response to the "low" level output 41′ of inverter 41, is applied through the AND gate 50 to the minute counter 51 to quickly advance it. The outputs of the seconds counter 27, the minutes counter 51 and the hours counter 52 are introduced in parallel to a display means (DISPLAY) 53 and visually displayed in a well known manner. It is, of course, apparent that other ways of utilizing the quick advance signal would be obvious to one skilled in the art. The above example, utilizing only a single gate is given to demonstrate the extremely simple manner of advance signal utilization.

Figures 4, 5:
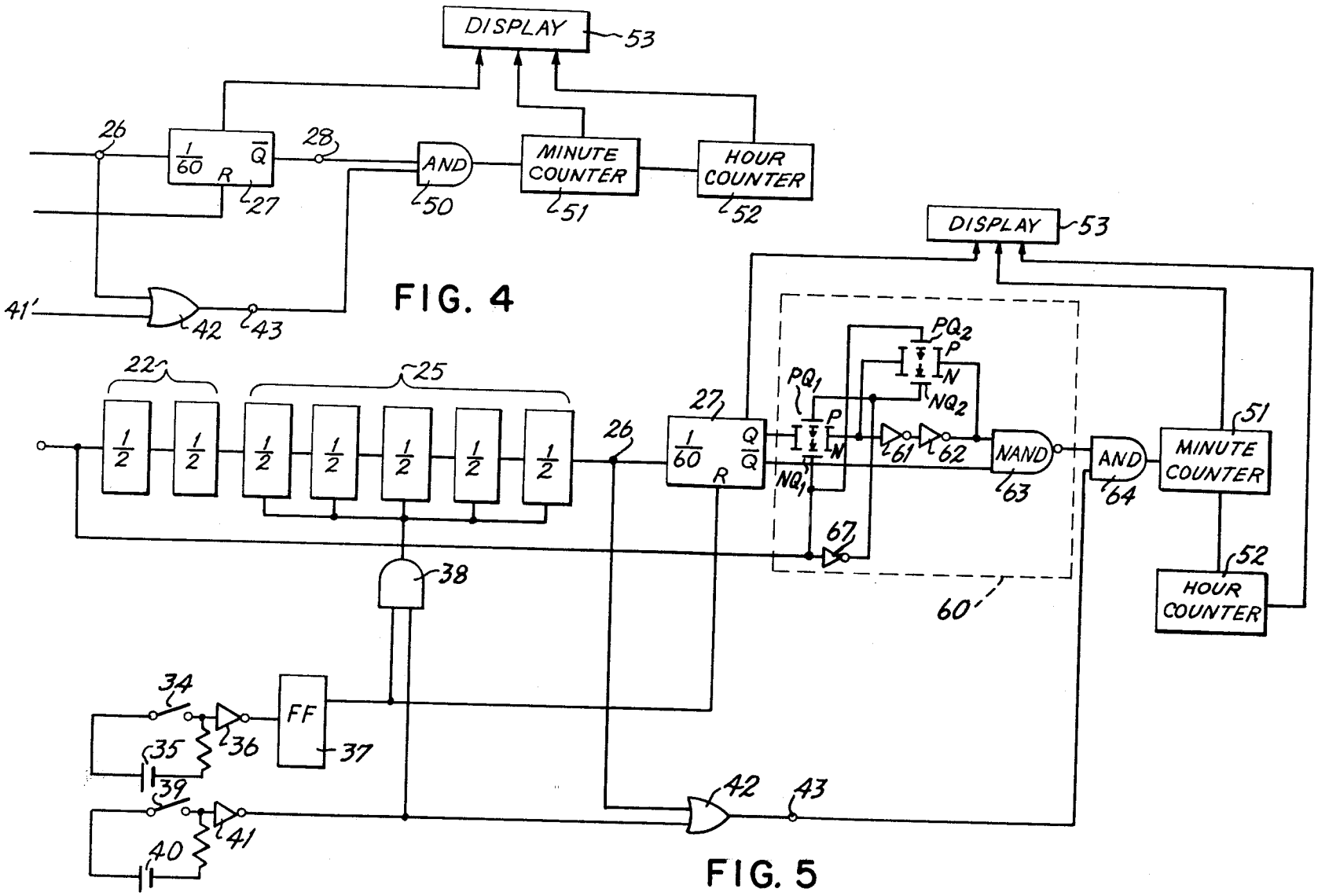
FIG. 4 is a block diagram representing one example of a display and second, minute, and hour counting portion of an electronic timepiece to be coupled with the signal generator of FIG. 2.
FIG. 5 is a block diagram representing another example of an electronic timepiece employing the advancing signal generator of FIG. 2.
Figure 6:
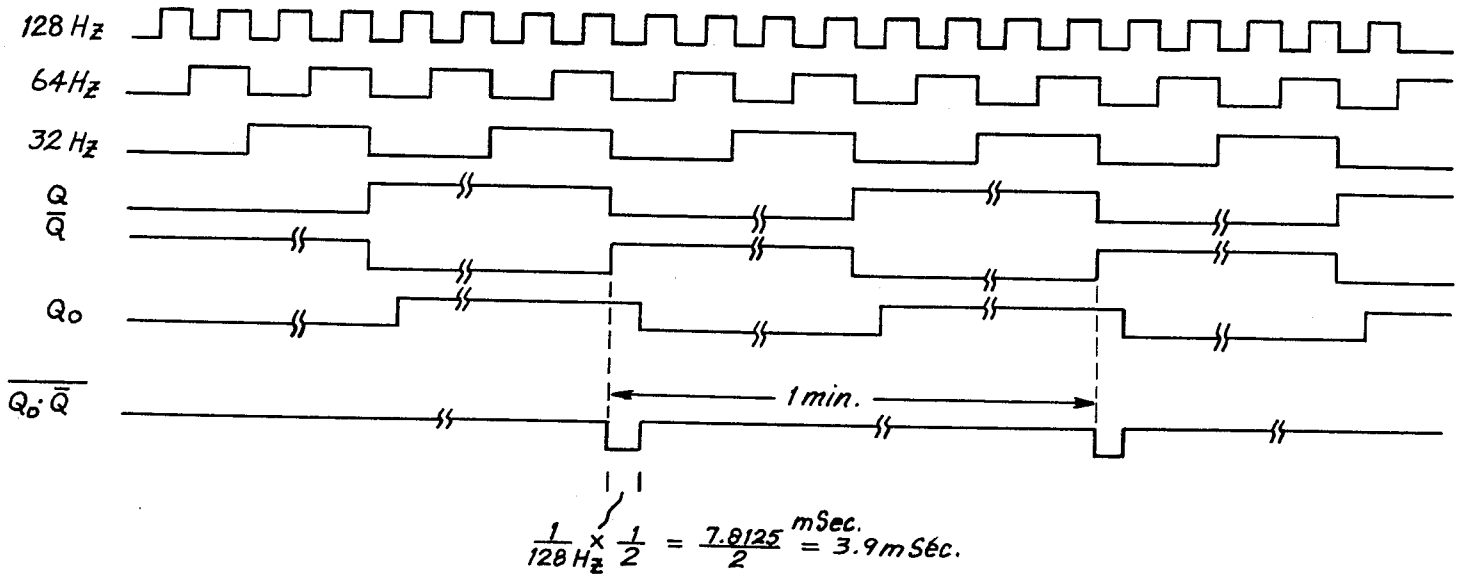
FIG. 6 shows major timing wave forms in the block diagram of FIG. 5.

With reference to FIGS. 5 and 6, another example of an electronic timepiece utilizing the advancing signal generator of FIG. 2 will be described. As shown in FIG. 5, the outputs Q and Q of the second counter 27 are transferred to a minute counter 51 through a wave-shaping circuit 60 and an AND gate 64. The wave-shaping circuit 60 comprises P channel insulated-gate field-effect transistors $PQ_1$ and $PQ_2$, N channel insulated-gate field-effect transistors $NQ_1$ and $NQ_2$, inverters 61, 62 and 67 and a NAND gate 63. In the circuit 60, a pair of transistors $PQ_1$ and $NQ_1$ and a pair of transistors $PQ_2$ and $NQ_2$ are used as C-MOS type switch respectively. The pair of transistors $PQ_1$ and $NQ_1$ is used for sampling an output Q of the second counter in response to a high level of the 128 Hz signal, while another pair of transistors $PQ_2$ and $NQ_2$ is used for holding the sampled output Q in a closed loop including the inverters 61 and 62 in response to a low level of the 128 Hz signal. Thus, a delayed output $Q_0$ having a delay time corresponding to half cycle time of the 128 Hz signal i.e. $1/128 \times \frac{1}{2} = 3.9$ m Sec from the output Q is produced at the output of the inverter 62 and applied to the NAND 63. In the NAND gate 63, NAND logic operation between the delayed output $Q_0$ and the output $\overline{Q}$ of the second counter 27 is performed to output a minute carry signal represented by $Q_0 \cdot \overline{Q}$ at its output terminal. The minute carry signal has a 1 minute cycle and becomes a low level during the 3.9 m Sec at the leading edge of the respective cycle. Wave forms explaining the operation of the circuit 60 are shown in FIG. 6. In normal operation, the carry signal derived from the NAND gate 64 is transferred to the minute counter 51 via AND gate 64 since the level at the terminal 43 is a high level. While in timesetting operation, the 1 Hz signal derived at the terminal 26 is transferred to the minute counter 51 through the OR gate 42 and the AND gate 64 in response to the low level of the output 41′ and the high level of the output of the NAND gate 63. The outputs of the second counter 27, the minute counter 51 and the hour counter 52 are introduced in parallel to a display means 53 and visually displayed as well.

A signal of 1 Hz is used as a quick advance signal in the aforesaid embodiments. A signal of 2 Hz may be used instead of the 1 Hz signal. In this respect, the signal is taken from a junction of the ½-frequency dividers 32 and 33 in the frequency dividing circuit 25, and the aforesaid signal may be used as an input to the OR gate 42. On the other hand, it may be considered that a quick advance signal having a frequency no lower than 2 Hz, such as for instance, a signal of 4 Hz, is used for the purpose of shortening the setting period Tx. However, this would result in an increase in the display speed of a liquid crystal display element, so that this attempt is not recommendable from the viewpoint of the practical application.

On the other hand, a normal drive signal of 32 Hz for the liquid crystal is used. However, a signal of 64 Hz may be used instead. In this case, the ½-frequency divider 24, as well, may be so designed as to be reset. In this respect, the maximum error of 15.625 mS in time setting is achieved, presenting satisfactory time accuracy.

Furthermore, since an error of no less than 100 mS in time-setting is not allowed from veiwpoint of an electronic timepiece, ½-frequency divider 30 and those dividers downstream thereof may be reset into which an output of 16 Hz (i.e., 62.5 mS) of the ½-frequency divider 29 is to be fed as an input. It is apparent that the error introduced in this case is 62.5 mS at the maximum.

What is claimed is:

1. A quick advancing signal generator for adjusting an electronic timepiece comprising frequency dividing means for generating a first signal of at least 1 Hz from a signal of a predetermined frequency, a "second" counter for counting said 1 Hz signal and including a reset terminal, an output terminal, a first input switch having a first and a second state, a second input switch having a first and a second state, means for generating a reset signal during the first state of said first input switch, means for applying said reset signal to the reset terminal of said "second" counter, first gating means for transferring said first signal from said frequency dividing means to said output terminal as a quick advancing signal in response to the first state of said second input switch, and second gating means for transferring said reset signal to said frequency dividing means in response to the second state of said second input switch to reset said frequency dividing means, said first gating means comprising, an OR gate having two inputs, said inputs being supplied with said first signal and a signal representing one of said first and second states of said second input switch, respectively, and an output of said first gating means being applied to said output terminal.

2. A quick advancing signal generator for adjusting an electronic timepiece comprising fequency dividing means for generating a first signal of at least 1 Hz from a signal of a predetermined frequency, a "second" counter for counting said 1 Hz signal and including a reset terminal, an output terminal for deriving a quick advancing signal a first input switch having a first and a second state, a second input switch having a first and a second state, means for generating a reset signal during the first state of said first input switch, means for applying said reset signal to the reset terminal of said "second" counter, first gating means for transferring said first signal from said frequency dividing means to said output terminal of the quick advancing signal in response to the first state of said second input switch and second gating means for transferring said reset signal to said frequency dividing means in response to the second state of said second input switch to reset said frequency dividing means, said second gating means comprising an AND gate having two inputs, said two inputs being supplied with said reset signal and a signal representing said first and second states of said second input switch, respectively, and an output of said second gating means being applied to the reset terminal of said frequency dividing means.

3. A system for generating a quick advancing signal for time-setting in an electronic timepiece comprising frequency dividing means for generating a first signal of at least 1 Hz from a predetermined frequency, a "second" counter for counting said 1 Hz signal and including a reset terminal, an output terminal, a first input switch having a first and a second state, a second input switch having a first and a second state, means for generating a reset signal during the first state of said first input switch, means for applying said reset signal to the reset terminal of said "second" counter, first gating means having two inputs, one of said two inputs being supplied with a signal representing said first and second state of said second input switch, the other of said two inputs being supplied with said first signal, said first gating means being controlled by the signal representing said first state of said second input switch to transfer said first signal to said output terminal as said quick advancing signal, second gating means having two inputs, one of said two inputs of said second gating means being supplied with the signal representing said first and second state of said second input switch, the other of said two inputs of said second gating means being supplied with said reset signal, said second gating means being controlled by the signal representing said second state of said second input switch to transfer said reset signal to the reset terminal of said dividing means.

4. The system of claim 3, further comprising means for generating said signal of predetermined frequency.

5. The system of claim 3, further comprising a quartz oscillator for generating said signals of predetermined frequency.

6. Time-setting apparatus for time-setting in an electronic timepiece comprising frequency dividing means for generating a first signal of at least 1 Hz from a signal of a predetermined frequency and including a reset terminal, a "second" counter for counting said first signal and including a reset terminal, a first input switch for generating an output, said output having a first and a second level, a second input switch for generating an output, said output having a third and a fourth level, means for generating a reset signal in response to receiving said first level, means for applying said reset signal to the reset terminal of said "second" counter, a first gate for receiving said first signal and the output of said second input switch, and a second gate for receiving said reset signal and the output of said second input switch, said first gate transferring said first signal to a minute counter in an electronic timepiece as a quick advancing signal when siad output of said second input switch is in said third level, and said second gate transferring said reset signal to the reset terminal of said frequency dividing means when said output of said second input switch is in said fourth level.

7. The generator according to claim 1 or 2, in which said first input switch includes a first single pole switch and a flip-flop whose state is reversed in response to a change in the state of said first single pole switch.

8. The generator according to claim 1 or 2, in which said first and second input switches include inverter circuits.

9. The system according to claim 3, in which said first input switch includes a first single pole switch.

10. The system according to claim 9, in which said second input switch includes a second single pole switch operable independently of said first single pole switch.

11. The system according to claim 9, in which said first gating means includes an OR gate.

12. The system according to claim 9, in which said second gating means includes an AND gate.

13. The system according to claim 3, in which said means for generating includes a flip-flop controlled by said first input switch.

14. The apparatus according to claim 6, in which said first input switch includes a first single pole switch and said second input switch includes a second single pole switch operable independently of said first single pole switch.

15. The apparatus according to claim 6, in which said first gate includes an OR gate.

16. The apparatus according to claim 6, in which said means for generating includes a flip-flop circuit controlled by said first signal.

* * * * *

UNITED STATES PATENT AND TRADEMARK OFFICE

CERTIFICATE OF CORRECTION

PATENT NO. : 4,247,932

DATED : January 27, 1981

INVENTOR(S) : Yukuo Kodama

It is certified that error appears in the above—identified patent and that said Letters Patent is hereby corrected as shown below:

IN THE CLAIMS

Claim 6, Column 8, Line 21 -

"siad" should be --said--

Signed and Sealed this

*Twelfth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,247,932

DATED : January 27, 1981

INVENTOR(S) : Yukuo Kodama

It is certified that error appears in the above—identified patent and that said Letters Patent is hereby corrected as shown below:

On page 1, please add the following Foreign Application Priority Data:

August 14, 1974 Japan.....93016/74

Signed and Sealed this

*Sixteenth* Day of *June 1981*

[SEAL]

*Attest:*

RENE D. TEGTMEYER

*Attesting Officer* *Acting Commissioner of Patents and Trademarks*